US006068530A

United States Patent [19]

Ozawa

[11] Patent Number: 6,068,530

[45] Date of Patent: May 30, 2000

[54] OXYGEN SENSOR ARRANGEMENT FOR WATERCRAFT

[75] Inventor: Shigeyuki Ozawa, Shizuoka, Japan

[73] Assignee: Yamaha Hatsudoki Kabushiki Kaisha, Japan

[21] Appl. No.: 09/104,855

[22] Filed: Jun. 25, 1998

[30] Foreign Application Priority Data

Jun. 25, 1907 [JP] Japan ..... 9-169113

[51] Int. Cl.[7] ..... B63H 21/32; B63C 7/00

[52] U.S. Cl. ..... 440/89; 114/55.53

[58] Field of Search ..... 440/88, 89, 1, 440/2; 73/116, 23.31, 23.32; 114/55.5, 55.53; 60/321, 276, 310

[56] References Cited

U.S. PATENT DOCUMENTS 5,271,477 12/1993 Gekka et al. .
5,271,480 12/1993 Takegami .
5,309,885 5/1994 Rawlings et al. .
5,433,634 7/1995 Nakayama et al. .
5,584,281 12/1996 Katoh .
5,637,792 6/1997 Kimura et al. .
5,694,909 12/1997 Kato .
5,711,148 1/1998 Katoh .
5,712,422 1/1998 Kato .
5,788,547 8/1998 Ozawa et al. ..... 440/89
5,911,609 6/1999 Fujimoto et al. ..... 440/89
5,931,712 8/1999 Hattori et al. ..... 440/89

*Primary Examiner*—S. Joseph Morano
*Assistant Examiner*—Patrick Craig Muldoon
*Attorney, Agent, or Firm*—Knobbe, Martens, Olson & Bear, LLP

[57] ABSTRACT

A marine engine is constructed having an improved component layout so as to reduce the risk of water contact with an oxygen sensor of the engine. This advantage is accomplished by providing a collection chamber that promotes drainage of any water that may enter into the chamber through an exhaust system. In one form, the oxygen sensor chamber has a lower wall and a passage thereof, both slanted downward toward the corresponding cylinder of the engine. The oxygen sensor may be shielded by a portion of the engine (e.g., by the induction system or the cylinder block) or by a portion of the corresponding exhaust system. In another variation, the oxygen sensor can be located for easily access in order to facilitate service and replacement.

33 Claims, 13 Drawing Sheets

OXYGEN SENSOR ARRANGEMENT FOR WATERCRAFT

BACKGROUND OF THE INVENTION

1. Field of the Invention

The present invention relates in general to an engine, and in particular to a component layout for a marine engine, including an arrangement for the oxygen sensor.

2. Description of Related Art

Internal combustion engines are commonly used to power small watercrafts such as personal watercraft. These watercraft include a hull which defines an engine compartment. Personal watercraft often employ an inline, multi-cylinder, crankcase compression, two-cycle engine. The engine conventionally lies within the engine compartment with the in-line cylinders aligned along a longitudinal axis of the watercraft hull. An output shaft of the engine is coupled to a water propulsion device of the watercraft, such as an impeller.

Generally, the engine of the small watercraft further includes an air intake system, an exhaust system, a fuel supply system, and other components to operate the engine. Air is supplied to the engine from the outside of the hull for use in the combustion process. Typically, air flows through one or more ducts in the hull into the engine compartment, and then through the intake system to the cylinders. An exhaust system communicates with the cylinders of the engine and extends to a discharge that is located near the stem of the watercraft.

Performance of the combustion process is monitored and controlled. An oxygen sensor is provided to the engine to monitor oxygen concentration in the exhaust gases, which is used to control the amount of fuel to be supplied to the combustion process. The oxygen sensor is very sensitive to water, and water that contacts the sensor may deteriorate the sensitivity and/or the durability of the sensor.

SUMMARY OF THE INVENTION

An aspect of the present invention involves an engine for a small watercraft. The engine includes at least one combustion chamber and an exhaust system that communicates with the combustion chamber to expel exhaust gases therefrom. A collection chamber receives exhaust gases through a passage that forms part of the collection chamber. A sensor is connected to the collection chamber in this position that lies partially within a cavity of the collection chamber. The collection chamber has a lower wall at least a portion of which slants downward, away from the sensor and towards the combustion chamber. In this manner, any liquid (e.g., water) which may condense, collect, or flow into the collection chamber will tend to flow out the collection chamber under the force of gravity.

Another aspect of the present invention involves a watercraft comprising a hull that defines an engine compartment and an access opening that opens into the engine compartment. An internal combustion engine is positioned within the engine compartment and is located at least partially below the access opening. The engine includes at least one cylinder. An exhaust system communicates with the cylinder to expel exhaust gases therefrom. An oxygen sensor is also arranged to monitor oxygen content in the exhaust gases from the cylinder. The oxygen sensor is arranged so as to be at least partially shielded from water that may pass through the access opening into the engine compartment. In one mode, a portion of the exhaust system covers the oxygen sensor to shield it from water entering through the access opening. In another mode, an induction system of the engine shields a portion of the oxygen sensor.

In accordance with an additional aspect of the present invention, a watercraft comprises a hull that defines an engine compartment. An internal combustion engine is positioned within the engine compartment. The engine includes at least one cylinder that extends upwardly from the crankcase. The crankcase contains a crankshaft that rotates about a rotational axis. The cylinder includes an axis that is generally normal to rotational axis with both axes lying within a common plane. An exhaust system communicates with the cylinder to expel exhaust gases therefrom. An oxygen sensor is arranged to monitor the oxygen concentration in the exhaust gases from the cylinder. The exhaust system is connected to the cylinder on one side of the common plane and the oxygen sensor is connected to the cylinder on the other side of the common plane.

A further aspect of the present invention involves a watercraft comprising a hull defining an engine compartment and an access opening that opens into the engine compartment. An internal combustion engine is positioned within the engine compartment and lies at least partially below the access opening. The engine includes an intake system communicating with an engine cylinder and an exhaust system communicating with at least the cylinder to expel exhaust gases therefrom. An oxygen sensor is arranged to monitor exhaust concentrations in the exhaust gases. The oxygen sensor is also arranged so as not to be covered by the intake system or the exhaust system and is positioned to generally lie below the access opening. In this position, the oxygen sensor can be readily reached in order to service or replace the oxygen sensor.

In accordance with an additional aspect of the present invention, a watercraft comprises a hull defining an engine compartment. An internal combustion engine is positioned within the engine compartment and the engine includes at least one cylinder. An exhaust system communicates with the at least one cylinder to expel exhaust gases therefrom. An oxygen sensor includes a sensor element arranged to monitor the oxygen concentration in the exhaust gases from the cylinder. At least an elevated portion of the exhaust pipe, which lies downstream of the sensor element of the oxygen sensor, extends higher than the sensor element. This arrangement inhibits a backflow of water through the exhaust system to the oxygen sensor. In one mode, the hull includes an access opening that lies over at least part of the engine. The oxygen sensor is arranged so as to be partially shielded from water that may pass through the access opening into the engine compartment by the elevated portion of the exhaust pipe.

Further aspects, features, and advantages of the present invention will become apparent from the detailed description of the preferred embodiments that follow.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF PREFERRED EMBODIMENTS OF THE INVENTION

The present invention has particular utility for use with a personal watercraft. Before describing the present invention, however, an exemplary personal watercraft will first be described in general details to assist the reader's understanding of the engine. The present invention can be readily adapted by those skilled in the art for use with other types of watercraft as well, such as, for example, but without limitation, small jet boats and the like, as well as for use in other applications.

Figure 1:
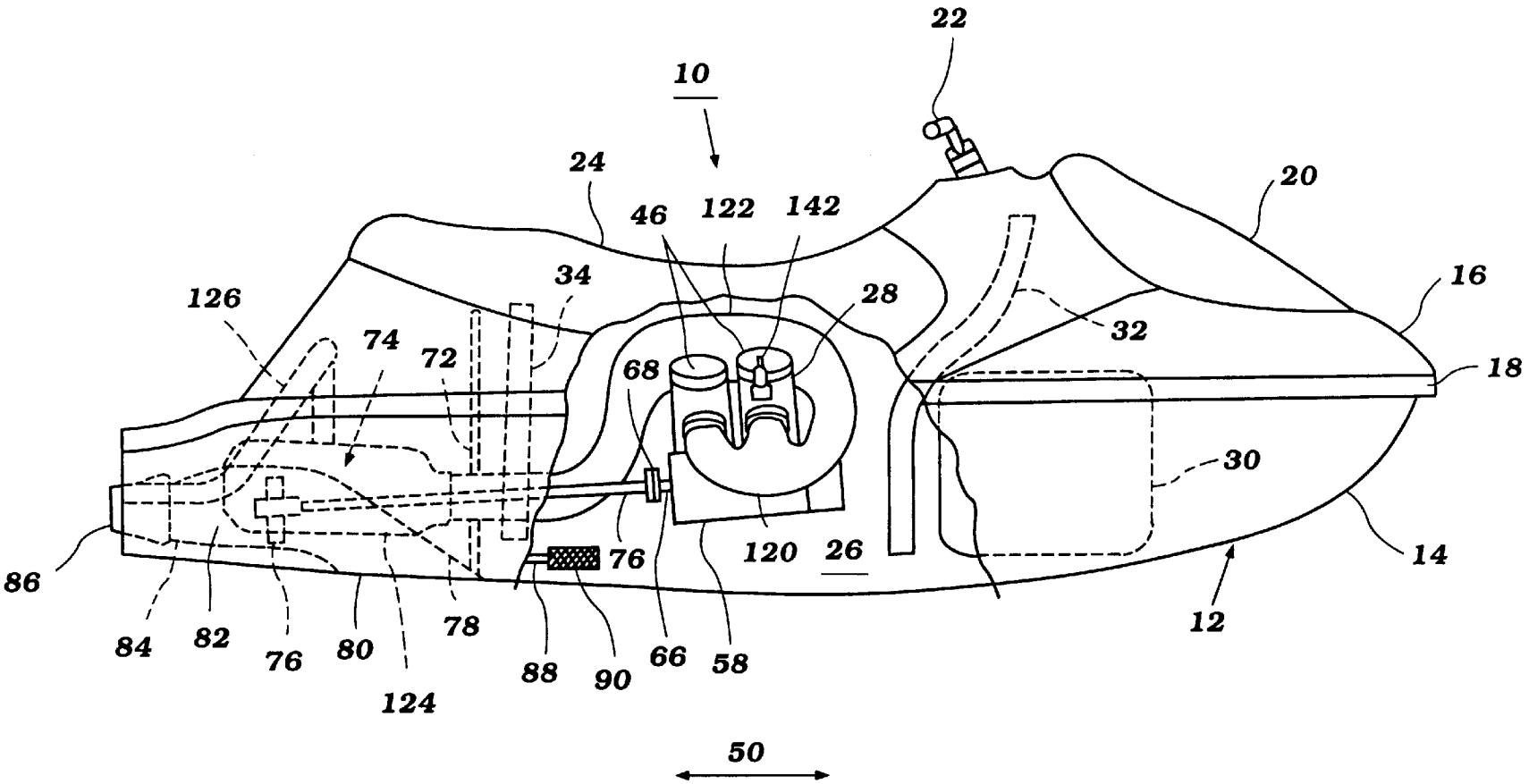
FIG. 1 is a side elevational view of a small watercraft configured in accordance with a preferred embodiment of the present invention and partially sectioned to illustrate an engine compartment and several other internal components of the watercraft in phantom.

With reference to FIG. 1, an exemplary personal watercraft 10 is illustrated. The watercraft 10 includes a hull 12 formed by a lower hull section 14 and an upper deck section 16. The hull sections 14, 16 are formed from a suitable material such as, for example, a molded fiberglass-reinforced resin. The lower hull section 14 and the upper deck section 16 are fixed to each other around the peripheral edges 18 in any suitable manner.

As viewed in the direction from the bow to the stem of the watercraft 10, the upper deck section 16 includes a bow portion at the front of the watercraft 10, a control portion extending rearward therefrom, and a seating area extending from the control area towards the back of the watercraft. The bow portion slopes upwardly towards the control portion and includes an opening (not shown) for access to the interior of the watercraft hull 12. A hatch or lid 20 covers the opening to inhibit an influx of water into the hull 12, and also slopes upwardly to the control portion.

The control portion extends rearward from the bow portion and includes a display panel (not shown) and a handlebar assembly 22. The handlebar assembly 22 controls the steering of the watercraft 10 in a conventional manner and also carries a variety of watercraft controls, such as, for example, a throttle control, a start switch and a lanyard switch.

The seating area comprises an operator/passenger seat 24 detachably mounted longitudinally along the center of the watercraft 10 that may be straddled by an operator, in the middle of the watercraft 10, and by at least one or two passengers to the rear during use. The middle position of the operator on the watercraft 10 gives the watercraft fore and aft balance when the operator rides alone. Although not illustrated, the seat 24 can be made as two discrete sections: a front seat section and a rear seat section, both detachably mounted separately to the upper deck section 16 using known latching mechanisms.

Figure 2:
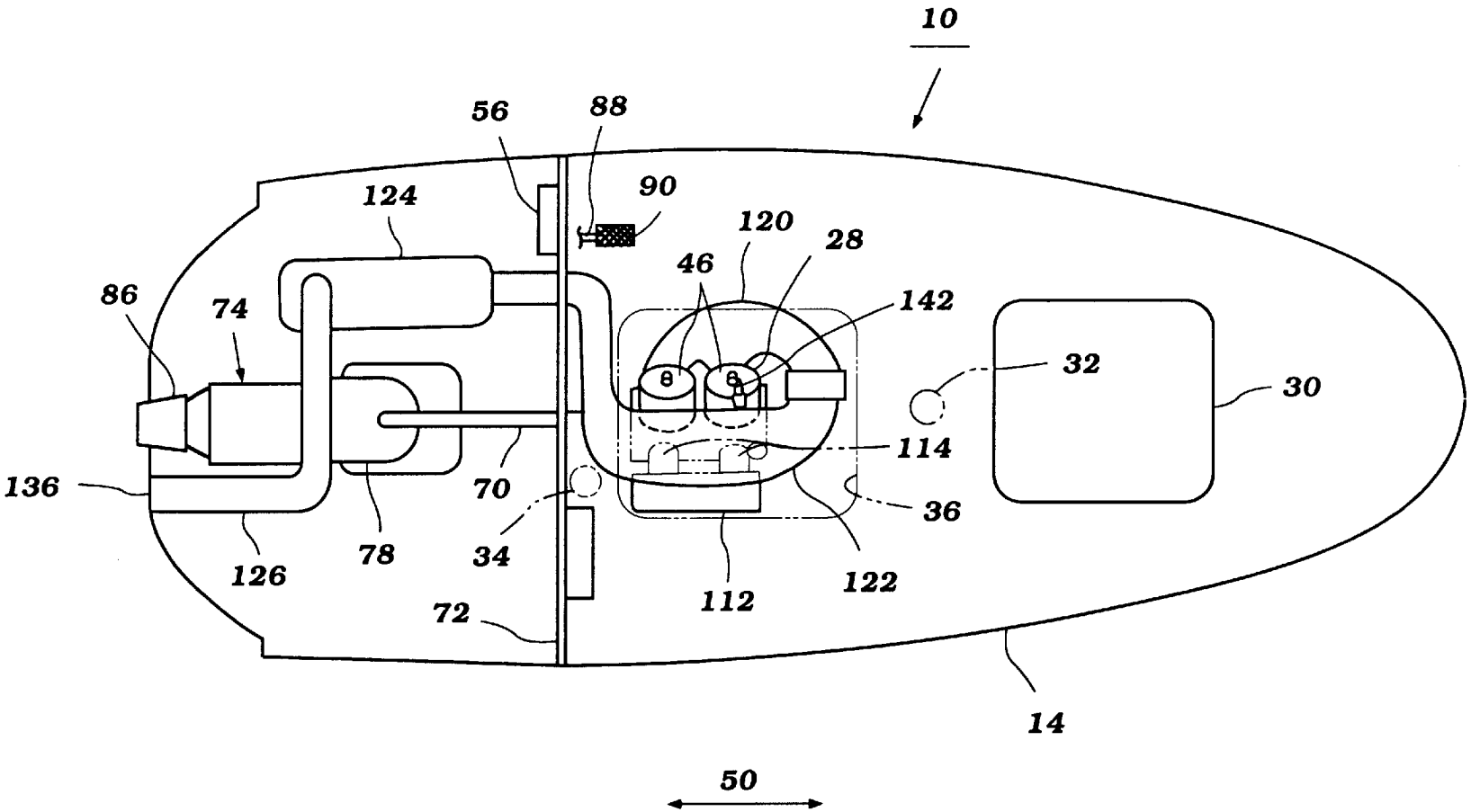
FIG. 2 is a top plan view of the watercraft of FIG. 1 and illustrates the interior arrangement of the engine compartment and an exhaust system of an engine.

As shown in FIGS. 1 and 2, the lower hull section 14 of the personal watercraft 10 includes within its interior an engine compartment 26 that houses an engine 28 and peripheral components and/or systems below the seat 24. Such peripheral systems that will be described in more detail include an air intake system, a fuel delivery system, and an exhaust system.

A fuel tank 30 and a buoyant block (not shown) are located within the lower hull section 14 in front of the engine compartment 26. The fuel tank 30 is mounted to an interior surface of the lower hull section 14 using a plurality of fuel tank mounts (not shown). The buoyant block adds buoyancy to the watercraft 10.

Typically, an air supply system ventilates the engine compartment 26 by supplying fresh air thereto. Such an air supply system desirably includes at least one air duct, and preferably at least two. For example, one air duct 32 may be located toward the front of the engine compartment 26 while another air duct 34 is provided toward the rear of the engine compartment 26.

The engine 28, which powers the watercraft 10, is located within the engine compartment 26 and is mounted in approximately a central position in the watercraft 10. The present embodiment of the engine and associated components will be described principally in reference to FIGS. 1 and 3; however, the drawings of several additional embodiments will be referred to in order illustrate some of the components which are better illustrated in the latter embodiments described below.

As seen in FIG. 2, an access opening defined in the upper deck section 16 separates the engine compartment 26 from the seat 24. The seat 24 covers the access opening 36 so that the removal of the seat 24 exposes the engine 28 within the engine compartment 26. A seal member 37 (see FIG. 9) is provided around the access opening 36 to prevent water influx into the engine compartment 26.

Figure 3:
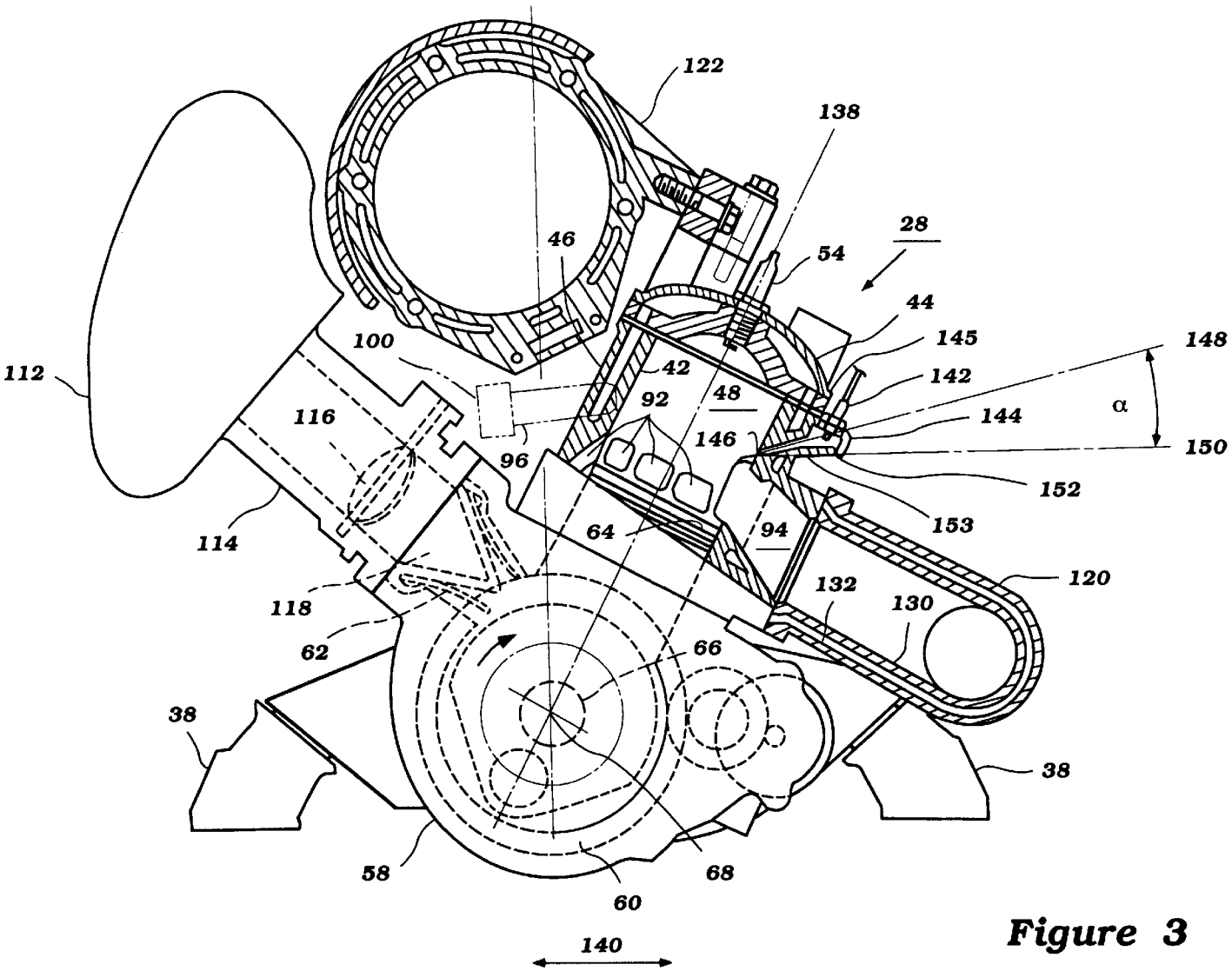
FIG. 3 is a partially sectioned, front elevational view of the engine and the exhaust system of FIG. 2.

As shown in FIG. 3, a plurality of engine mounts 38 secure the engine 34 to the hull 12 and support the engine 28 within the engine compartment 26 of the watercraft 10. Each engine mount 38 preferably comprises a pad constructed from rubber or a similar vibration dampening and isolating material to reduce the impact felt by engine components as the hull 12 of the watercraft 10 bounces on the surface of the body of water during use.

The engine 28 includes a cylinder block 40 that defines a plurality of in-line cylinder bores 42. A cylinder head assembly 44 is located on top of the cylinder block 40 and cooperates with the cylinder bores 42 to form cylinders 46. Each of the cylinders 46 encloses a combustion chamber 48, in which combustion process takes place in a controlled manner. The engine 28 is positioned such that the row of cylinders 46 lies in a longitudinal direction 50 of the watercraft 10 that runs bow to stem.

A spark plug 54 (FIG. 3) is mounted atop each recess of the cylinder head assembly 44 and has its gap extending into the combustion chamber 48. The spark plugs 54 are fired to bum fuel with air supplied within the combustion chamber 48 by an ignition control unit that is controlled by an electronic control unit (ECU) 56 (only shown in FIG. 2) of the engine 28.

A crankcase 58 is provided underneath the cylinder block 40. Individual crankcase chambers 60 (FIG. 3) of the engine 28 are formed within the crankcase 58 by dividing walls and sealing disks, and are sealed from one another. Each crankcase chamber 60 communicates with an air intake manifold of the air intake system, which is described in detail below, through a check valve 62 (e.g., reed-type valve as seen in FIG. 3).

As shown in FIG. 3, pistons 64, which reciprocate within the cylinders 46 of the engine 28, are connected to a crankshaft 66 (also shown in FIG. 1) through a connecting rod (not shown). The pistons 64 thereby drive the crankshaft 66, which in the illustrated embodiment also functions as the engine output shaft. The crankshaft 66 desirably is journaled to rotate about a rotational axis 68 within the crankcase 58.

With reference to FIG. 1, extending rearward from a lower portion of the engine 28 is the crankshaft 66 that is connected by a coupling 68 to an impeller shaft 70. The impeller shaft 70 extends rearward through a bulkhead 72 and a protective sleeve (not shown), to the jet propulsion unit 74. A bearing assembly (not shown), which is secured to the bulkhead 72 supports the impeller shaft 70 behind the coupling 68. The engine 28 powers the crankshaft 66 in a rotational manner so as to rotate the impeller 76 positioned at the rearward most end of the impeller shaft 70 to propel the watercraft 10.

The jet propulsion unit 74 is positioned in the rear center of the lower hull section 14 and in the illustrated embodiment includes a gullet 78 having an inlet opening 80 formed on the bottom side of the lower hull section 14. The gullet 78 extends from the inlet opening 80 to a pressurization chamber 82 which, in turn, communicates with a reduced-diameter nozzle section 84 of the propulsion unit 74. The jet propulsion unit 74 also includes the rotatable impeller 76 supported by the impeller shaft 70.

When rotating at high speeds, the impeller 76 pressurizes the water within the pressurization chamber 82 and forces the pressurized water through the nozzle section 84 of the jet propulsion unit 74. A steering nozzle 86 directs the exit direction of the water stream exiting the jet propulsion unit 74. The steering nozzle 86 is pivotally supported at the rear of the jet propulsion unit 74 to change the thrust angle on the watercraft 10 for steering purposes, as is known in the art. The steering nozzle 86 is connected to the steering handlebar 22 so as to be directed thereby. The steering handle 22 may also include a throttle control for controlling the output of the engine 28 and, thus, the rotation speed of the impeller 76.

The impeller 76 is located toward the front end of the pressurization chamber 82. A central support (not shown) supports the rear end of the impeller shaft 70 behind the impeller 76 and generally at the center of the pressurization chamber 82. A bearing assembly (not shown) journals the rear end of the impeller shaft 70 within the support.

Within the engine compartment, a water removal assembly is provided in fluid communication with the nozzle section 84 of the jet propulsion unit 74. Preferably, the water removal assembly comprises a bilge system that employs a conduit 88 that extends from an inlet or a water pickup 90 in the engine compartment 26 to the nozzle section 84. Due to the high rate of water flow through the nozzle section 84, a venturi effect is created that creates suction in the conduit 88. That suction effect draws water out of the engine compartment 26 through the bilge inlet or water pickup 90 adjacent the engine 28 and nears the bottom surface of the lower hull section 14. The water-pickup 90 is arranged to be slightly elevated from the bottom surface of the lower hull section 14 of the engine compartment 26.

Alternatively, the water removal system may employ a conventional pump (not shown) that directs water from the bilge region of the hull 12 through the conduit 88 to an outlet (not shown) at the stern of the watercraft 10. For example, the water may be expelled through an outlet located in a wall of the gullet 78.

Figure 4:
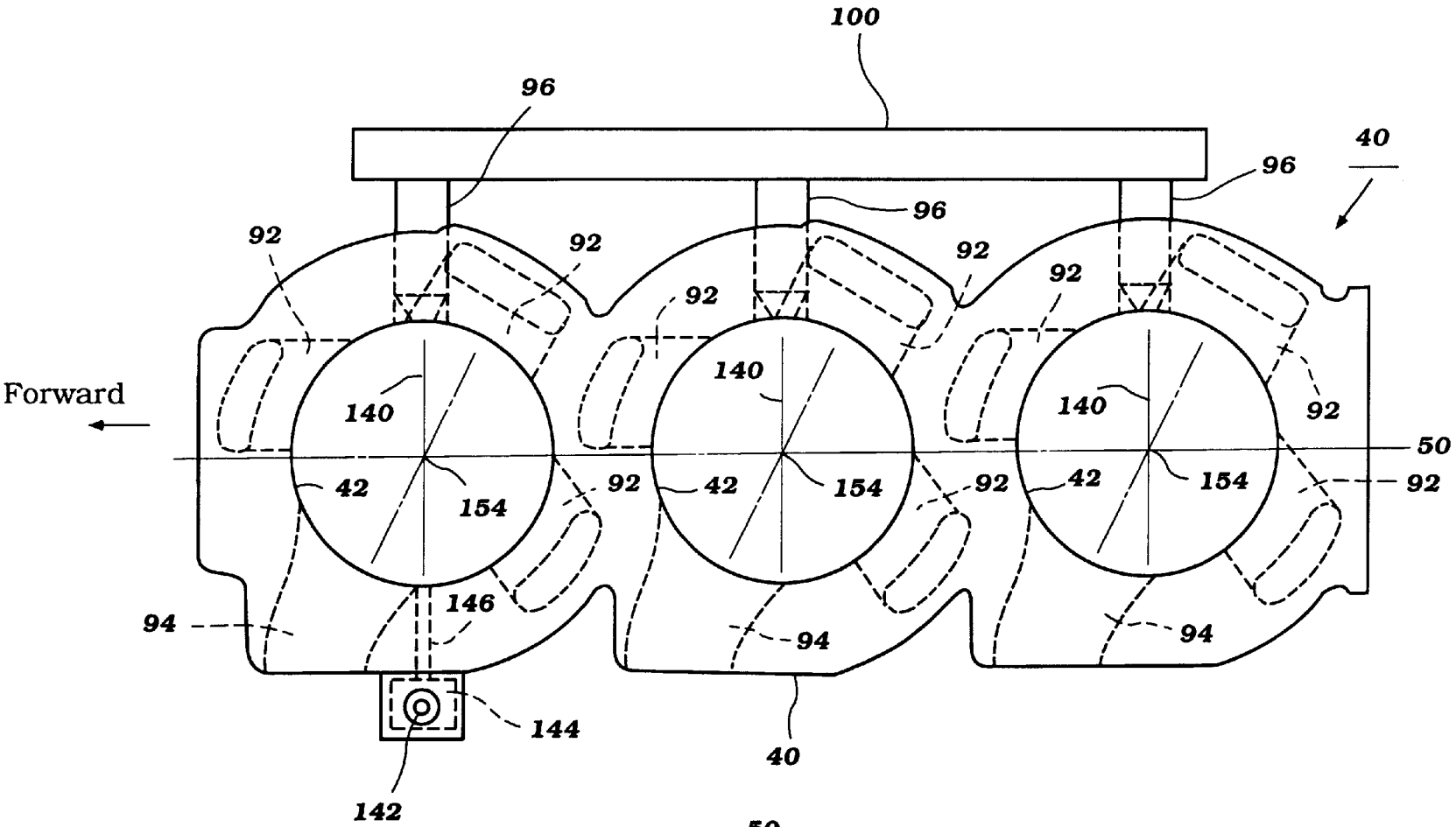
FIG. 4 is a top plan view of a variation of a cylinder block for the engine of FIG. 2, illustrating in phantom the configuration of scavenge passages and exhaust outlet ports of three cylinders.

With reference to FIGS. 3 and 4, a plurality of scavenge passages 92 are formed within each cylinder 46 to supply an air charge from the crankcase chamber 60 to the combustion chamber 48. It should be noted that the engine 28 illustrated in FIGS. 1–3 is a two-cylinder engine while the engine illustrated in FIG. 4 is a variation thereof and includes three cylinders. Those skilled in the art will readily appreciate that the arrangement of the scavenge passages described below can be applied equally to engines having two, three, or more cylinders. Accordingly, although the arrangement of the scavenge and exhaust passages within the cylinder block is aspect of the invention will be described in references to FIGS. 3 and 4, this aspect of the invention is not limited to two and three-cylinder engines.

Each scavenge passage 92 includes an inlet port that is disposed either at the lower end of the cylinder bore 42 or in a wall of the respective crankcase chamber 60. The scavenge passage 92 extends between the crankcase chamber 60 and a corresponding scavenge port. The scavenge port is disposed at a higher position along the cylinder bore 42 than is the inlet port of the scavenge passage, but is slightly below and on the opposite side of an exhaust outlet port 94. The scavenge port opens to the combustion chamber 48 formed in an upper region of each cylinder 46.

A charge former introduces fuel into the air charge. As will be recognized by those skilled in the art, the charge former may include either one or more carburetors or a set of fuel injectors. In the illustrated embodiment, as seen in FIG. 3, the charge formers are fuel injectors 96 that spray fuel into the corresponding combustion chambers 48. The fuel injectors 96, however, can alternatively spray fuel into a passage of the air intake system or into the crankcase chamber to form the fuel/air charge.

Fuel is transferred from the fuel tank 30 to the fuel pump 98 (as understood from FIG. 9), and then supplied to a fuel rail 100 through a fuel supply line 102 (as understood from FIG. 6) at a pressure by the fuel pump 98. The fuel pump 98 can be either mechanically or electrically driven. A fuel filter 104 (see FIG. 6), which is located within the fuel supply line 102, separates water and other contaminants from the fuel. The fuel supplied to the fuel rail 100 is distributed to the fuel injectors 96. The residual fuel returns back to the fuel pump 98 or to a fuel tank (e.g., the fuel storage tank 30) through a return line 106, within which a pressure regulator 108 is located to regulate the pressure in the fuel rail and the delivery and return lines 100, 102, 106.

As shown in FIGS. 2 and 3, an air intake system supplies an air charge to a plurality of crankcase chambers 60 formed within the crankcase 58 of the engine 28. Air is received by the air intake system through an air inlet port 110 (as understood from FIGS. 10 and 12) of an air intake silencer 112, which is located above and to the side of the cylinders 46. The air intake silencer 112 includes a plenum chamber, which communicates with a plurality of air intake pipes 114. The engine 28 preferably includes one air intake pipe 114 for each cylinder 46, in which each air intake pipe 114 houses a butterfly-type throttle valve 116 therewith. Each throttle valve 116 (FIG. 3) communicates with an intake passage of an intake manifold 118 attached to the crankcase 58 and/or cylinder block 40 to place each intake passage in communication with one of the crankcase chambers 60.

As described above, a check valve 62 (e.g., a reed valve) is disposed in the inlet port of each crankcase chamber 60 that communicates with each intake passage at the junction between the intake manifold 118 and the crankcase chamber 60. The reed valve 62 opens upon upward movement of the piston 64 to permit an influx of air into the corresponding crankcase chamber 60 and closes upon downward movement of the piston 64 to inhibit reverse air flow from the chamber 60 into the intake manifold 118.

Exhaust gases from the engine 28 are discharged desirably to the water in which the watercraft is operating through the exhaust system. The exhaust system includes an exhaust manifold 120, exhaust pipe 122, a water trap device 124, and a discharge pipe 126.

The exhaust manifold 120 is connected to the exhaust outlet port 94 of each of the cylinders 46 on one side of the cylinders to receive exhaust gases from the combustion chambers 48. The exhaust pipe 122 fluidicly communicates with and receives exhaust gases from the exhaust manifold 120. A catalyzer 128 (only shown in FIG. 5) is located within the exhaust pipe 122 and encloses a suitable catalytic material to treat and render harmless hydrocarbons, carbon monoxide, and oxides of nitrogen.

In the illustrated embodiment, the exhaust pipe 122 includes an expansion chamber in which the catalyzer 128 is located. It should be understood, however, that the catalyzer can be disposed at other locations within the exhaust system. The exhaust manifold in the present embodiment also forms a header pipe that extends forward of the engine 28. The header pipe terminates at an outlet that terminates in generally a lateral direction, which is perpendicular to the longitudinal direction 50. The inlet end of the exhaust pipe 122 connects to the outlet end of the header pipe of the exhaust manifold 120. The exhaust pipe 122 extends rearwardly along one side of the engine 28 next to the induction system 112 and thence crosses over a longitudinal center line of the watercraft on the rear side of the engine 28. Although not illustrated, the exhaust pipe 122 desirably includes a generally rigid section which forms the expansion chamber and a flexible conduit which connects an outlet end of the expansion chamber with a water trap device 124, as described below.

Figure 5:
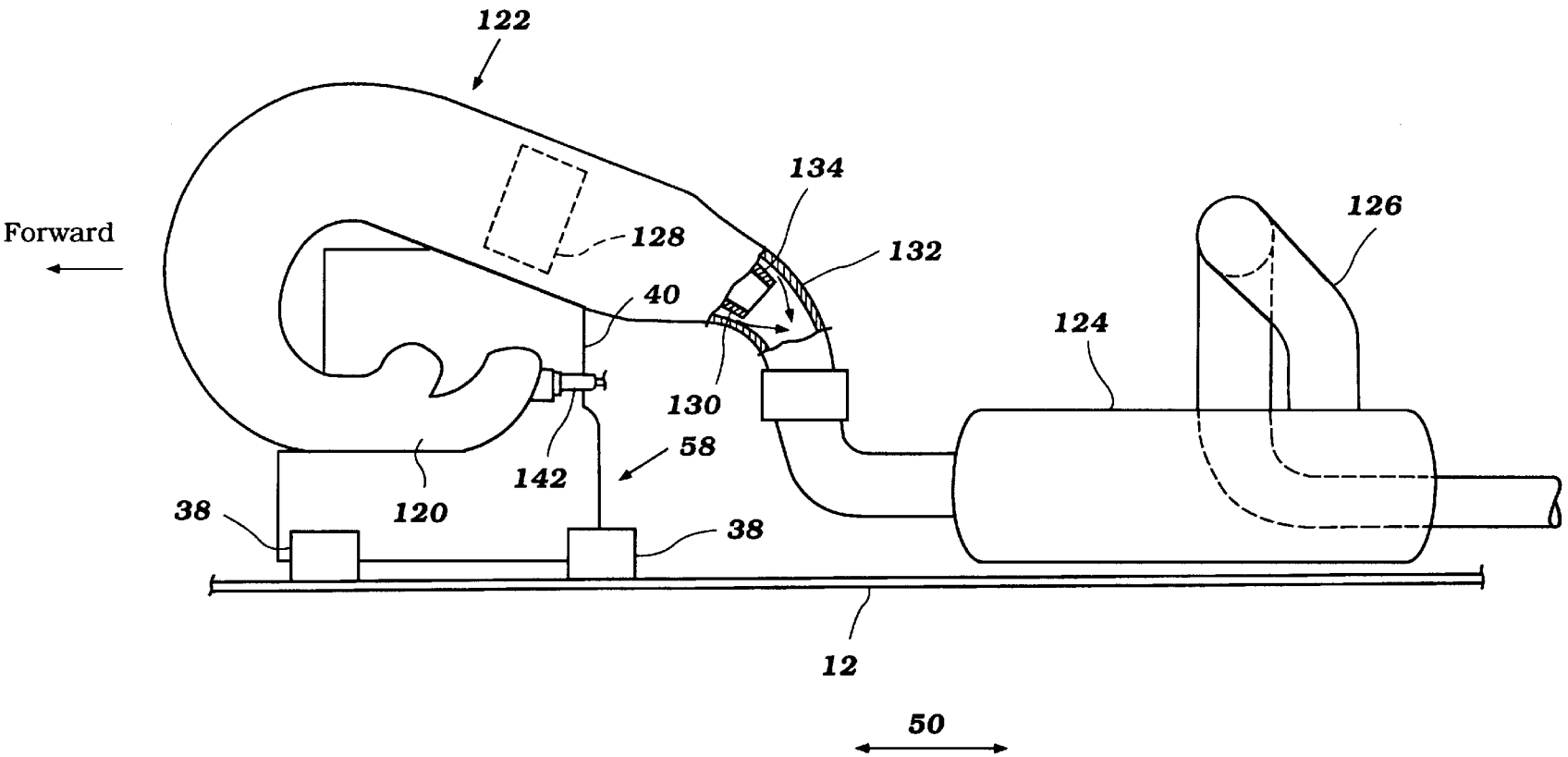
FIG. 5 is a side elevational view of an exhaust system (with a partially sectioned area) and an engine for a small watercraft configured and arranged in accordance with another embodiment of the present invention.

As shown in FIG. 3, the exhaust manifold 120 and the exhaust pipe 122 each include an inner tube 130 that provides a passageway to the exhaust gases and an outer tube 132 that surrounds the inner tube 130. The space between the inner and outer tubes 130, 132 forms a coolant jacket 134, within which coolant water circulates to cool the exhaust manifold 120 and exhaust pipe 122. The coolant water mixes with exhaust gases where the inner tube 130 ends, as shown in FIG. 5. As seen in FIG. 3, a shield can also cover a side of the exhaust pipe 122 that faces upward and toward the induction system 112.

The outlet of the exhaust pipe 122 is in fluid communication with the water trap device 124, located toward the rear of the watercraft 10. The water trap device 124 inhibits the back flow of water toward the exhaust tube 122. As shown in FIG. 1, the exhaust discharge pipe 126 connects the water trap device 124 to a discharge opening 136. The exhaust discharge pipe 126 extends over the jet propulsion unit 74 to further inhibit the water influx into the exhaust system.

FIGS. 2 and 3 also illustrate a desired layout and arrangement of several engine components in accordance with the preferred embodiment of the present invention. The engine 28 is arranged so that the each cylinder 46 is desirably inclined such that a longitudinal center plane 138 of the cylinders 46 is skewed in a lateral direction 140 of the watercraft 10. The crankcase 58, located below the cylinders 46, includes the crankcase chambers 60 located beneath each cylinder 46. The air intake system, more specifically the intake manifold 118, is attached on one side of the crankcase 58. Each cylinder 46 opens into the exhaust outlet port 94 on the opposite side of the cylinder 46 from the air intake manifold 118. The exhaust manifold 120 communicates with the combustion chambers 48 of the cylinders 46 through the exhaust outlet ports 94. The exhaust pipe 122, connected to the exhaust manifold 120, surrounds the forward side of the cylinder block 40 on the opposite side of the cylinder block 40 and extends slightly upward. Each of the fuel injectors 96 has its injecting end within the combustion chamber 48 and sprays the fuel directly into the combustion chamber 48, mixing the fuel with the air provided to the combustion chamber 48 through the scavenge passages 92 in the cylinder 46.

An oxygen sensor 142 is provided in the engine 28 to monitor the concentration of oxygen in the exhaust gases. The oxygen sensor 142 sends signals indicative of the oxygen concentration to the ECU 56, to which the oxygen sensor 142 is electrically connected. The ECU 56, upon the receipt of the signals, computes an air-to-fuel ratio (A/F) of the air-fuel mixture, which has been burned, producing the exhaust gases monitored by the oxygen sensor 142. Based on the computed air-to fuel ratio, the ECU 56 controls the amount of fuel injected or injection time into the combustion chamber 48 to ensure proper operation of the engine 20.

As shown in FIG. 3, the cylinder 46 includes a collection chamber 144 located near the exhaust outlet port 94, to which an individual branch of the exhaust manifold 120 is attached. The collection chamber 144 includes an opening to the cylinder bore 42 and a passage 146 which is tapered toward the opening and which leads to a cavity 145. The tapered passage 146 has a central axis 148, which is slanted at an angle $\alpha$, which is greater than zero, relative to a horizontal plane 150. Further, the lower wall 148 of the passage 146 is slanted relative to the horizontal plane 150. Advantageously, the lower wall 148 of the collection chamber cavity 145 is also slanted to the horizontal plane 150. The cavity 145 of the collection chamber 144 has a hole on its top wall into which the oxygen sensor 142 is installed with its sensor element 153 protruding into the cavity 145.

When an air and fuel mixture is burned by the ignition of spark plug 54 within the combustion chamber 48, the piston 64 is pushed down by the expanding gases and the exhaust outlet port 94 opens to expel the gases through the exhaust system. During this exhaust cycle of the engine 28 operation, some of the exhaust gases enter the chamber 144 via the opening and passage 146. The oxygen sensor 142, in turn, senses the oxygen concentration in the exhaust gases introduced into the chamber 144 and sends signals indicative of the concentration to ECU 56 as described above. The repetitive cycling of the piston circulates exhaust gases through the cavity 144.

In this embodiment, because the passage 146 as well as the lower wall 152 of the passage 146 and the chamber 145 are slanted, any water that may enter the chamber 144 easily drains out. When the watercraft 10 is upset during operation, water may flow back into the combustion chamber 48 through the exhaust system and even enter into the oxygen sensor chamber 144. However, when the watercraft 10 is righted, the water will flow down along the slant lower wall 152 of the passage 146 by gravity. Thus, this configuration of the oxygen sensor chamber 144 improves the durability of the oxygen sensor 142, which is sensitive to water contact.

As appreciated from FIGS. 2 and 3, the position of the oxygen sensor 144 is not covered by either the exhaust pipe 122 or the induction system 112. Rather, the oxygen sensor is positioned so as to be acceptable through the access opening 36 in the deck when the seat 24 is removed. This position facilitates convenient service of and repair to the oxygen sensor 142.

Although the present embodiment, as noted above, is described in the context of the cylinder block 40 having two in-line cylinders 46, variations in the number and/or configuration of the cylinders 46 are also applicable. For instance, FIG. 4 illustrates a cylinder block 40 that has three in-line cylinder bores 42 in the longitudinal direction 50 of the watercraft 10.

In the illustrated cylinder block 40, each of three fuel injectors 96, which are in fluid communication with the fuel rail is inserted into a through hole to each cylinder bore 42 to spray the fuel into the corresponding combustion chamber 48. The exhaust outlet port 94 is generally disposed on the opposite side of the cylinder block 40 from the fuel injectors 96. The passage 146 of the oxygen sensor chamber 144 opens to the bore 42 of the forward cylinder close to the exhaust outlet port 94. Three scavenge passages 92 and the exhaust port 94 are spaced around each cylinder bore 42 at about an equal angle from one another and from the center of each cylinder 46. In addition, the orientation of the scavenge passages 92 and exhaust outlet port 94 are turned at an angle with respect to the center axis 154 of each cylinder 46, such that the scavenge passages 92 of neighboring cylinders 46 alternate positions in the area between two neighboring cylinders 46. That is, at least one of the scavenge passages which communicates with the first cylinder is the only position between a pair of scavenge passages that communicates with an adjacent cylinder. Thus, the spacing between the center of the adjacent cylinders is less than twice the distance between the center of a cylinder and one of the scavenge passages. With this configuration of the scavenge passages 92 and the exhaust outlet port 94, the cylinder 46 block 40 and the length of the fuel rail 100, length in the longitudinal direction 50, can be reduced.

FIGS. 5 through 13 illustrate additional embodiments of engine component arrangement of a small watercraft 10 according to the present invention. In the following description of these embodiments, like elements are referred by like numerals, and the description of like components between the embodiments should be understood to apply to each of the embodiments, unless indicated otherwise.

Figure 6:
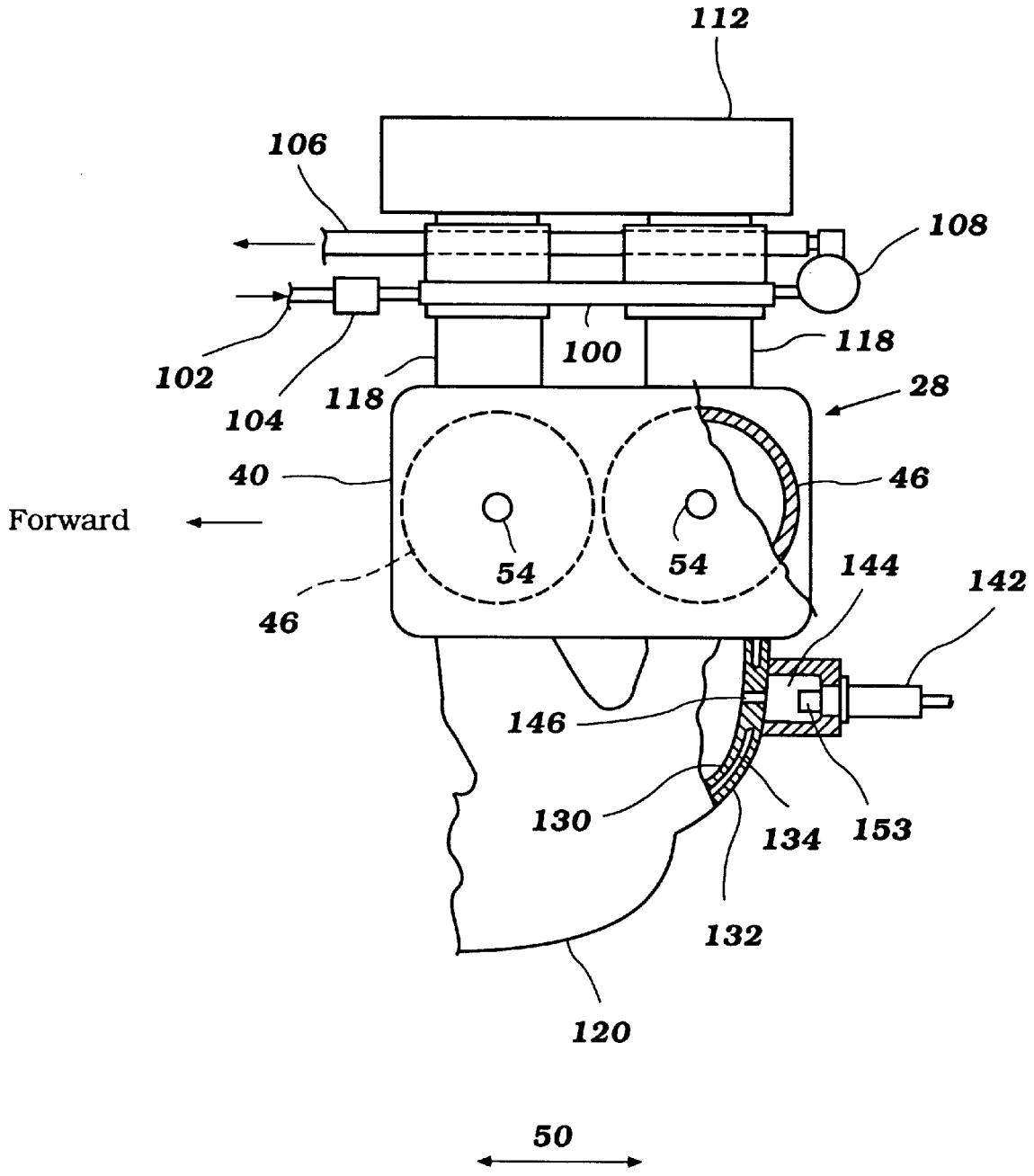
FIG. 6 is a partial sectional top plan view of the engine and the exhaust system of FIG. 5.

FIGS. 5 and 6 illustrate another embodiment of the present invention, in which a collection chamber 144 is located on the exhaust manifold 120. The collection chamber 144 communicates with the exhaust manifold 120 via a passage 146 provided through the inner and outer tubes 130, 132 of the exhaust manifold 120 near the exhaust outlet port 94 of one of the cylinders 46. In the illustrated embodiment, the oxygen sensor communicates with just one branch of the manifold 120. The oxygen sensor 142 is installed to the chamber 144 with the sensor element 153 positioned within the chamber 144. The oxygen sensor 142 monitors the concentration of oxygen within the exhaust gases that enter the chamber 144 when the corresponding cylinder 46 expels the exhaust gases.

In this embodiment, as shown in FIG. 5, the exhaust pipe 122 turns upward near the forward edge of the cylinder block 40 and then inclines downward toward the water trap device 124 from the highest level. Unlike the preceding embodiment, the exhaust pipe 122 does not extend across the cylinder block 40 to the opposite side to which the air intake manifold 118 is located. Instead, the inclined part of the exhaust pipe 122 is located above the exhaust manifold 120 and the oxygen sensor 142, which is connected to the exhaust manifold 120 through the oxygen sensor chamber 144. The elevated exhaust pipe 122 tends to preclude a back flow of water through the inner tube 130 of the exhaust pipe 122, thus inhibiting water from contacting the oxygen sensor 142 within the chamber 144. Further, the exhaust pipe 122 extends above at least a portion of the oxygen sensor 142 and shields the oxygen sensor 142 thereabove. The exhaust pipe 122 then inhibits water, which may enter the engine compartment 26 through the uncovered access opening 36, from contacting the oxygen sensor 142.

Figure 7:
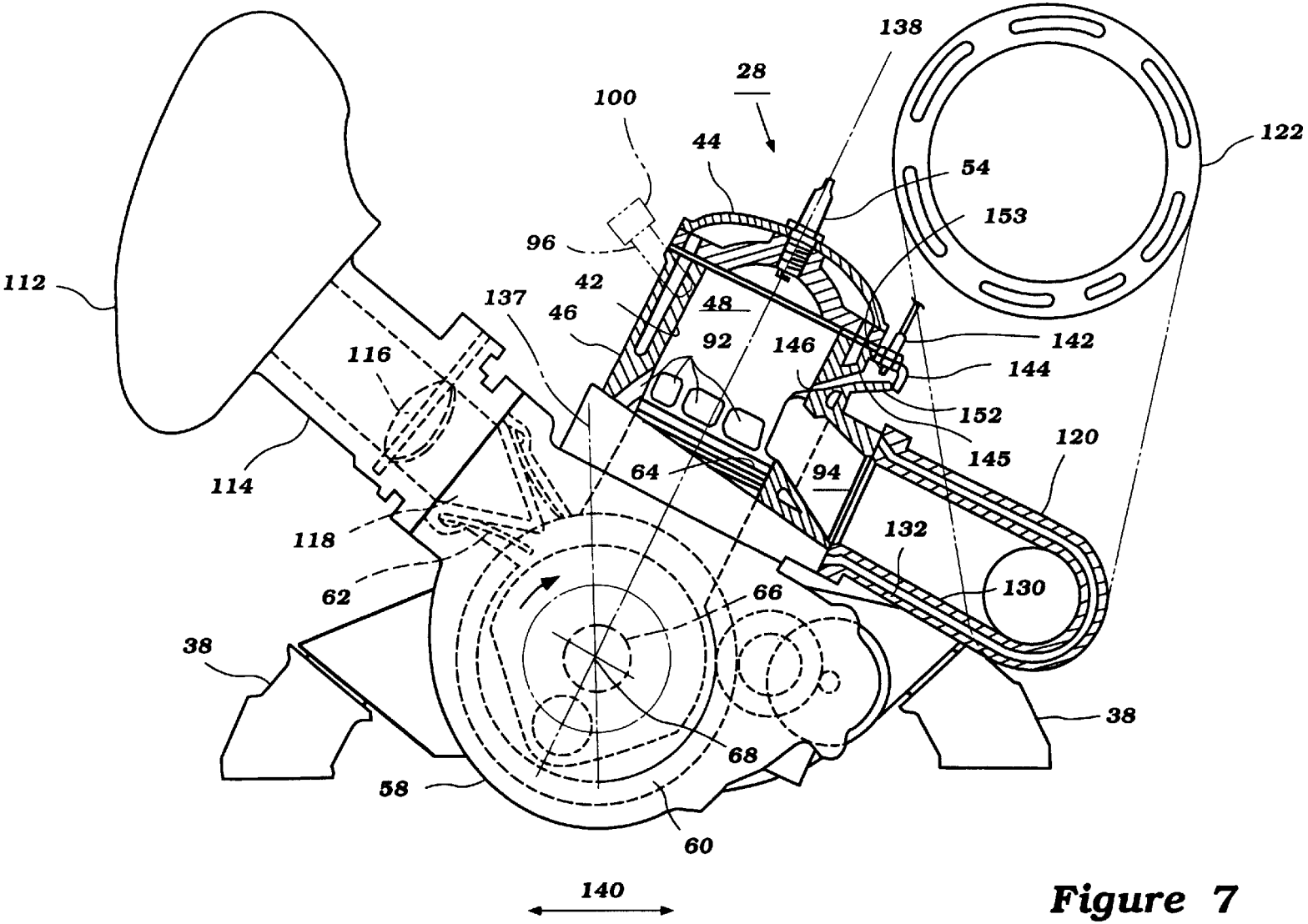
FIG. 7 is a partially sectioned, front elevational view of an engine and an exhaust system for a small watercraft configured and arranged in accordance with another embodiment of the present invention.
Figure 8:
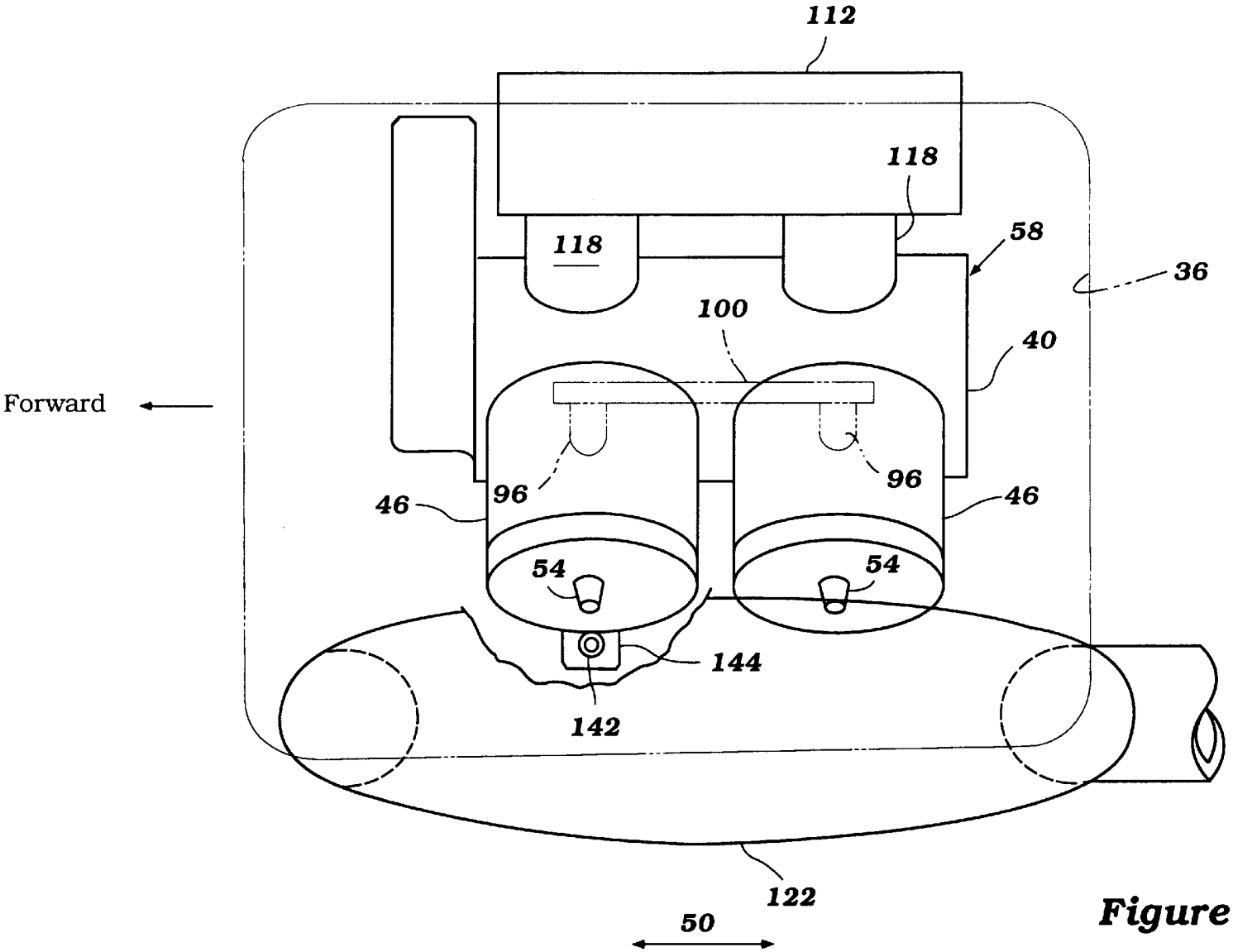
FIG. 8 is a partial top plan view of the engine and the exhaust system of FIG. 7.

FIGS. 7 and 8 illustrate an additional embodiment of the present invention, which is generally, a hybrid of the previous two embodiments described above. A collection chamber 144 is located within or attached to the cylinder block 40 on the same side to which the exhaust manifold 120 is attached. A passage 146, which has an opening close to the exhaust outlet port 94 of one of the cylinders 46, introduces exhaust gases into the chamber 144. An oxygen sensor 142 is installed to the chamber 144 with its sensing element 153 within the chamber 144 to monitor the oxygen concentration within the exhaust gases. The lower wall 152 of the passage 146 and the chamber cavity 145 is slanted relative to the horizontal plane 150 to easily drain water that may enter the chamber 144, as described above in connection with the above embodiment.

The exhaust pipe 122 of this embodiment turns upward near the forward edge of the cylinder block 40 in the same side with respect to the longitudinal plane 138 of the cylinder 46 block 40 as the exhaust manifold 120. In the illustrated embodiment, the plane 138 is inclined relative to a center longitudinal plane 139. The exhaust pipe 122 inclines toward the water trap device 124 from the highest level. The inclined part of the exhaust pipe 122 is located above the exhaust manifold 120 and the oxygen sensor 142 to shield the oxygen sensor 142 from water influx that may enter the engine compartment 26 through the access opening 36 when uncovered.

Figure 9:
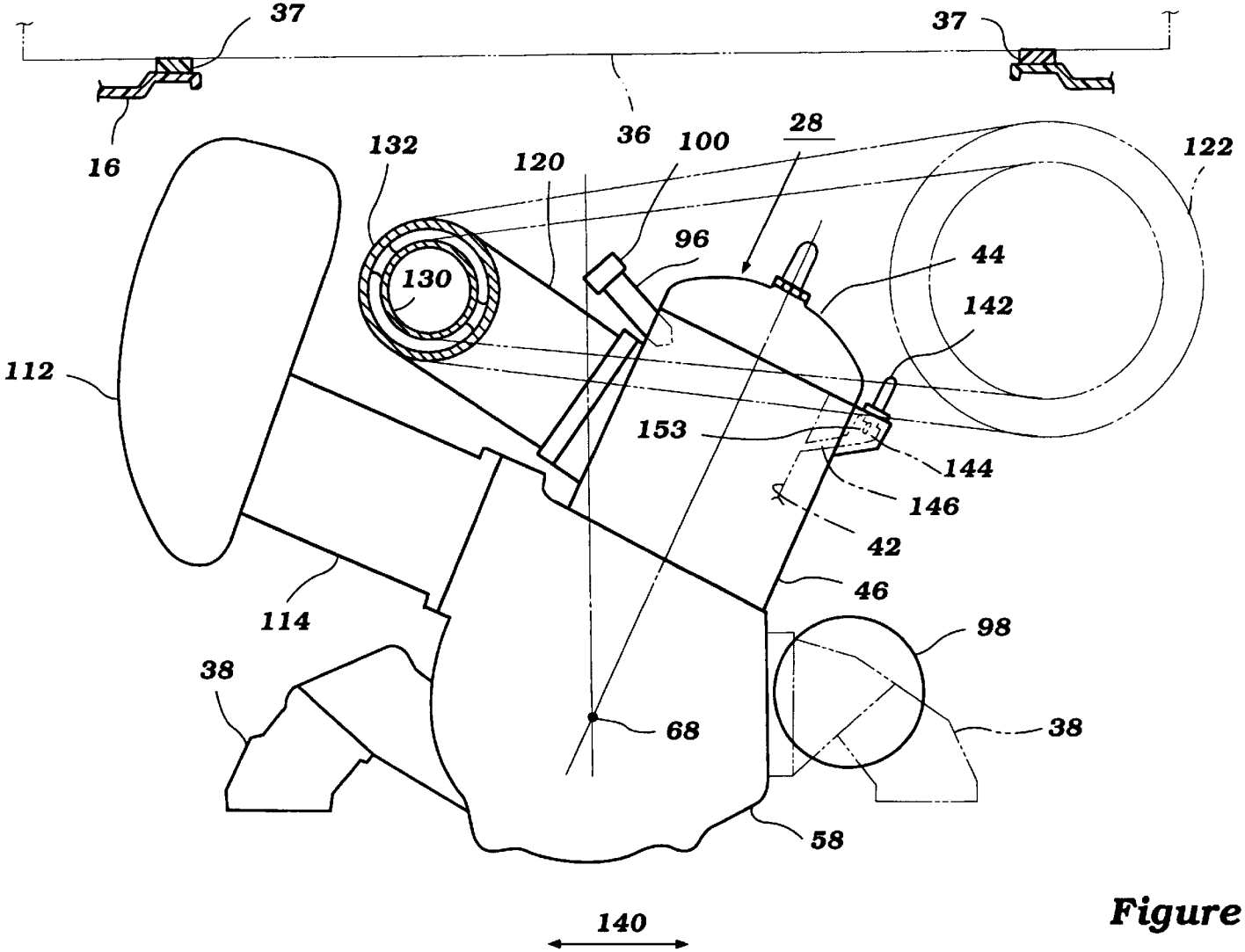
FIG. 9 is a partially sectioned, front elevational view of an engine and an exhaust system for a small watercraft configured and arranged in accordance with an additional embodiment of the present invention, and illustrates an oxygen sensor and associated collection chamber in phantom.

FIG. 9 illustrates another embodiment constructed in accordance with the present invention. In this embodiment, the exhaust manifold 120 is attached to the same side of the longitudinal plane 138 of the cylinder block 40 that the air intake manifold 118 is attached to the crankcase 58. The exhaust pipe 122, which fluidicly communicates with the exhaust manifold 120, surrounds either the forward or rearward side of the cylinder block 40 and extends to the opposite side of the cylinder block 40 from the exhaust manifold 120. The oxygen sensor 142 and the chamber 144 are located at a position opposite to the exhaust outlet port 94 of one of the cylinders 46. In this configuration, the exhaust pipe 122 extended to the opposite side from the exhaust manifold 120 shields the oxygen sensor 142 thereabove so that water that may enter the engine compartment 26 through the access opening 36 when uncovered is generally blocked from contacting the oxygen sensor 142.

Figure 10:
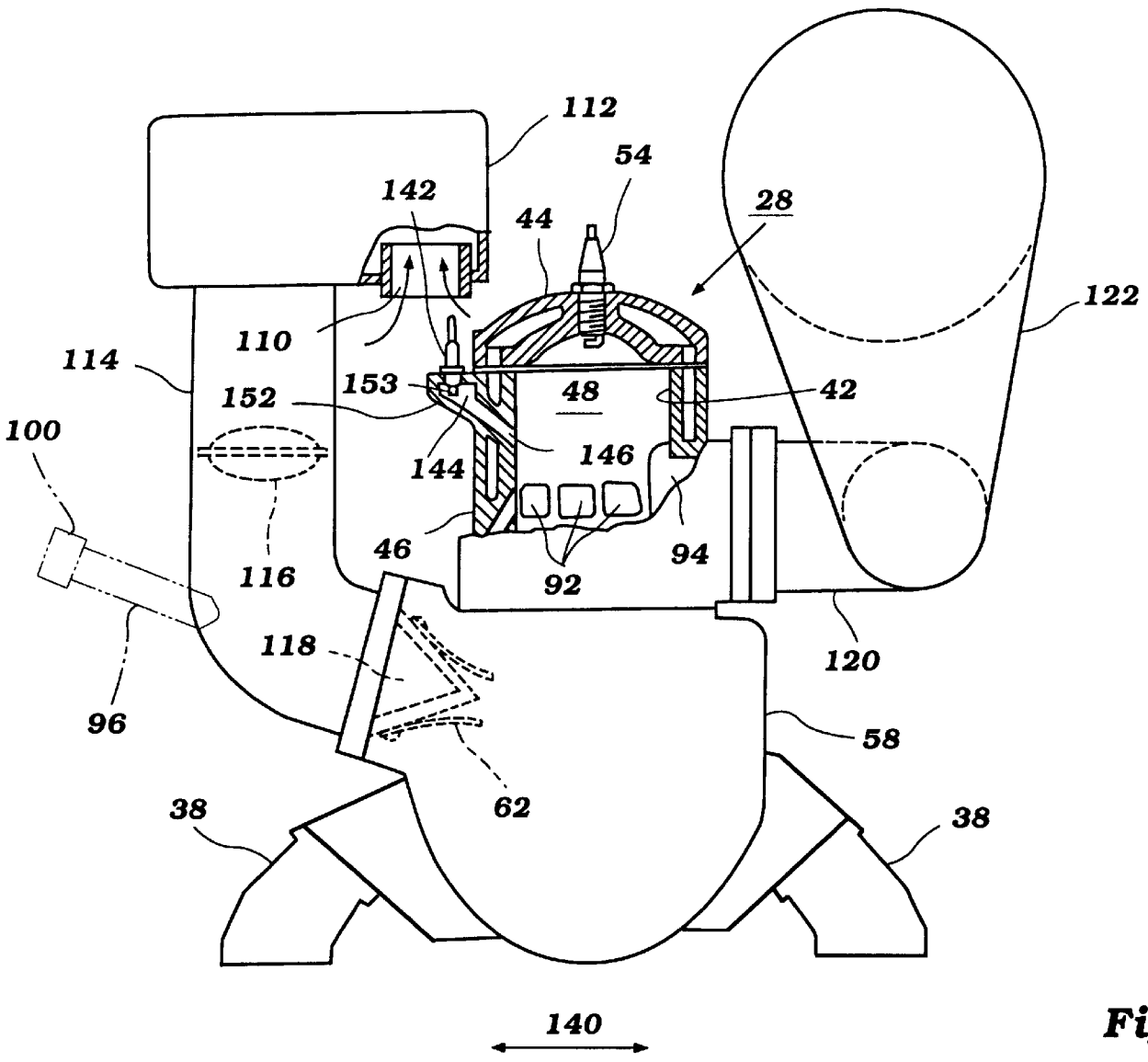
FIG. 10 is a partially sectioned front elevational view of an engine and an exhaust system for a small watercraft configured and arranged in accordance with a further embodiment of the present invention.
Figure 11:
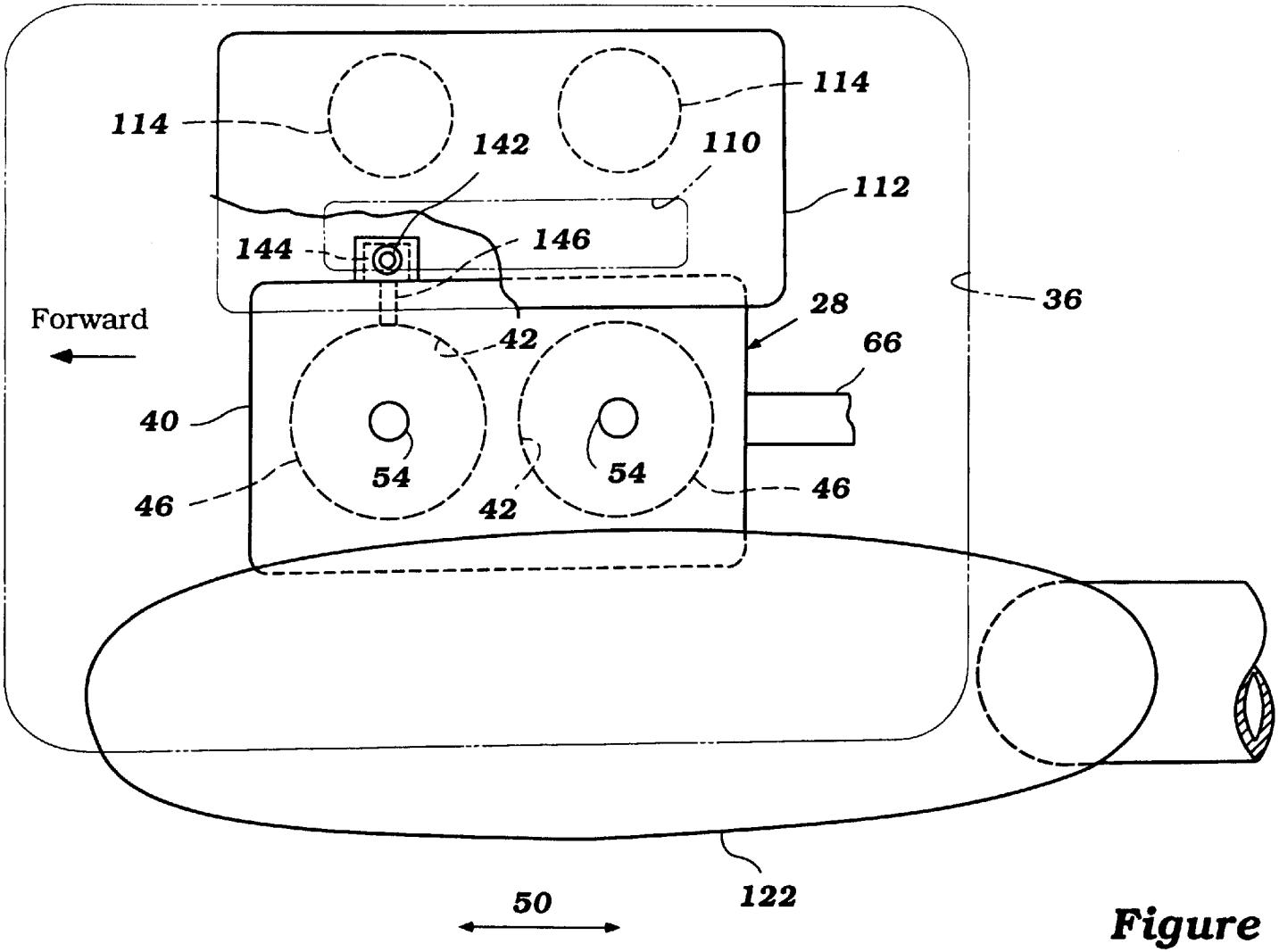
FIG. 11 is a partially sectioned, top plan view of the engine and the exhaust system of FIG. 10.

FIGS. 10 and 11 illustrate a further embodiment of the present invention. Unlike the previous embodiments, the illustrated engine 28 is arranged so that the longitudinal center plane 138 of the cylinders 46 stands perpendicular to the horizontal plane 150 (i.e., is generally vertical). The oxygen sensor 142 and the chamber 144 are located at a position opposite the exhaust outlet port 94 of one of the cylinders 46. The air intake silencer 112 is located above the oxygen sensor 142 and the chamber 144 thereof to shield the oxygen sensor 142 from water influx that may enter the engine compartment 26 through the access opening 36 when uncovered. The exhaust pipe 122 has a similar configuration to the embodiment illustrated as described above. In addition, the fuel injector 96 is mounted in the passage 146 of the air intake pipe 114 so that the fuel is sprayed into the air intake pipe 114. The intake pipe 114 delivers the resulting air and fuel change to the corresponding crankcase charger through the check valve (e.g., reed-valve).

Figure 12:
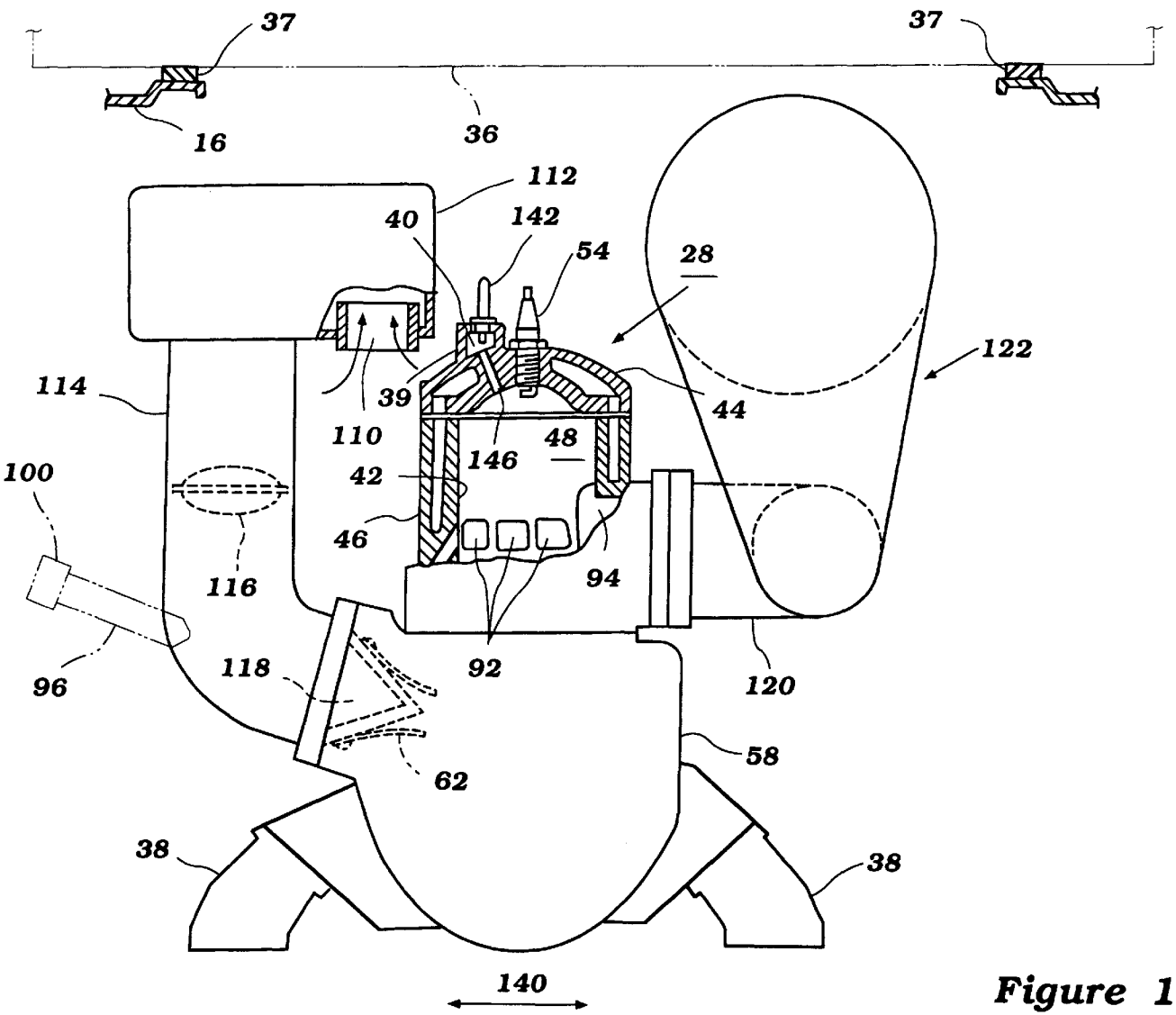
FIG. 12 is a partially sectioned front elevational view of an engine and an exhaust system for a small watercraft configured and arranged in accordance with an additional embodiment of the present invention.
Figure 13:
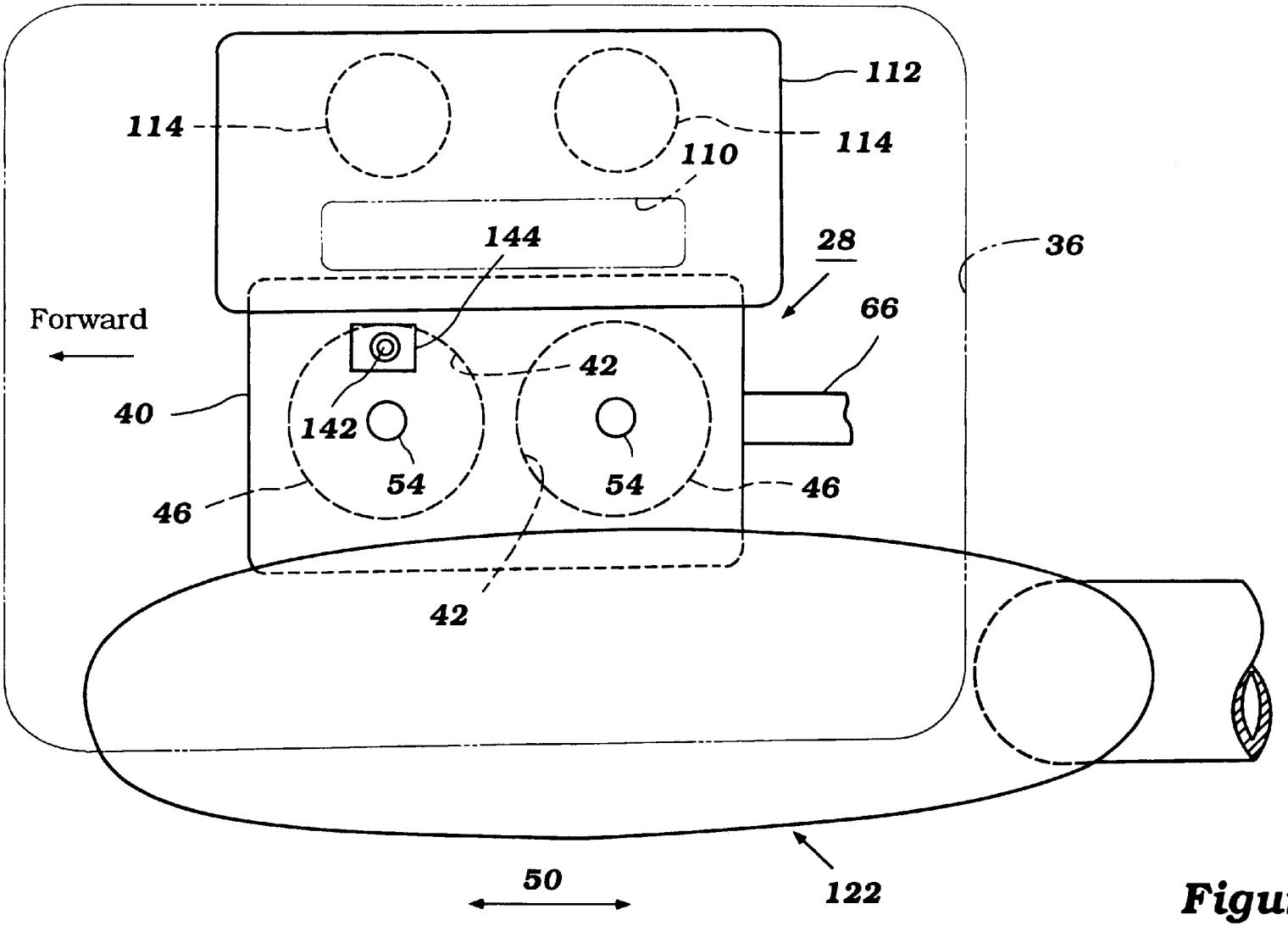
FIG. 13 is a partially sectioned, top plan view of the engine and the exhaust system of FIG. 12.

An additional embodiment of the present invention is illustrated in FIGS. 12 and 13, and is substantially the same as the embodiment illustrated in FIGS. 10–11, except for a variation in the arrangement of the oxygen sensor 142 and the chamber 144. The oxygen sensor chamber 144 of this embodiment is located on the cylinder head assembly 44 rather than the cylinder block 40. A passage 146 is formed between the collection chamber 144 and the combustion chamber 48 within the cylinder head assembly 44. Like several of the above embodiments, the passage slants downward toward the respective combustion chamber 48. The oxygen sensor 142 is advantageously installed into the top wall of the chamber 144 so that access to the oxygen sensor 142 through the access opening 36 of the upper deck section 16 is facilitated.

Although this invention has been described in terms of certain preferred embodiments, other embodiments apparent to those of ordinary skill in the art are also within the scope of this invention. In addition, those skilled in the art will appreciate that many aspects of one embodiment can be combined with those of another embodiment to obtain a blending of the advantages noted above. For instance, the arrangement of the collection chamber and passage on the cylinder head, as shown in FIG. 12, can be used in connection with the engine arrangement illustrated in FIG. 7, as will be readily appreciated by one skilled in the art. Accordingly, the scope of the invention is intended to be defined only by the claims that follow.

What is claimed is:

1. An engine for a small watercraft comprising at least one combustion chamber, an exhaust system that communicates with the at least one combustion chamber to expel exhaust gases therefrom, a collection chamber that receives the exhaust gases through a passage thereof and a sensor connected to the collection chamber and positioned at least partially within a cavity of the collection chamber, the collection chamber having a lower wall of which at least a portion slants downward, away from the sensor and toward the combustion chamber, said lower wall extending from an opening of the passage and through the length of the collection chamber.

2. An engine as defined in claim 1, wherein the lower wall of the passage is inclined.

3. An engine as defined in claim 2, wherein the lower wall of the collection chamber cavity is inclined.

4. An engine as defined in claim 1, wherein the sensor is an oxygen sensor.

5. An engine as defined in claim 1, wherein the passage of the collection chamber opens to the exhaust system.

6. An engine as defined in claim 5, wherein the exhaust system comprises an exhaust manifold in communication with the combustion chamber, and the passage of the collection chamber opens to the exhaust manifold.

7. An engine as defined in claim 1, wherein the sensor is connected to the collection chamber in a manner exposing a sensor element of the sensor to the volume within the collection chamber.

8. An engine as defined in claim 7, wherein a hole, which is formed on a top wall of the collection chamber, receives at least a portion of the sensor.

9. An engine as defined in claim 1, wherein at least a portion of the exhaust system is located above the sensor.

10. An engine as defined in claim 1 additionally comprising an air intake system that provides air to the at least one combustion chamber, at least a portion of the air intake system being located above the sensor.

11. An engine as defined in claim 10, wherein the air intake system comprises an air intake silencer, and the air intake silencer is located above the sensor.

12. An engine as defined in claim 1, wherein at least part of the collection chamber passage extends through a portion of a cylinder head of the engine, and the respective cylinder head forms a portion of the combustion chamber with which the passage communicates.

13. An engine as defined in claim 12, wherein the collection chamber is integrally formed with the cylinder head.

14. An engine as in claim 1 additionally comprising a cylinder block defining a plurality of cylinders arranged in line, each cylinder communicating with a plurality of scavenge passages formed in the cylinder block, at least one scavenge passage being located at a first distance away from an axis of the corresponding cylinder, and adjacent cylinders are positioned apart from each other by a second distance, the second distance being less than twice the first distance.

15. An engine as in claim 1 additionally comprising a cylinder block defining at least another cylinder arranged adjacent to the one cylinder, each cylinder communicating with a plurality of scavenge passages formed in the cylinder block, at least one of the scavenge passages, which communicates with the one cylinder, being generally positioned between a pair of scavenge passages, which communicate with the other cylinder.

16. An engine for a small watercraft comprising at least one combustion chamber, an exhaust system that communicates with the at least one combustion chamber to expel exhaust gases therefrom, a collection chamber that receives the exhaust gases through a passage thereof and a sensor connected to the collection chamber and positioned at least partially within a cavity of the collection chamber, the collection chamber having a lower wall of which at least a portion slants downward, away from the sensor and toward the combustion chamber, and an exhaust port selectively communicating with the combustion chamber, said passage of the collection chamber being open to the combustion chamber, and the opening to the passage of the collection chamber lying near the exhaust port.

17. An engine as defined in claim 16, wherein the passage of the collection chamber selectively communicates directly with the combustion chamber.

18. A watercraft comprising a hull defining an engine compartment, an internal combustion engine being positioned within the engine compartment, the engine including at least one cylinder that extends upward from a crankcase, the crankcase containing a crankshaft that rotates about a rotational axis, the cylinder including an axis that is generally normal to the rotational axis with both axes lying within a common plane, an exhaust system that communicates with the at least one cylinder to expel exhaust gases therefrom, and an oxygen sensor arranged to monitor oxygen concentration in the exhaust gases from the cylinder, and the exhaust system being connected to the cylinder on one side of the common plane and the oxygen sensor being connected to the cylinder on the other side of the common plane, said oxygen sensor being connected to the exhaust system.

19. A watercraft as defined in claim 18, wherein the oxygen sensor is connected to the engine.

20. A watercraft as in claim 18, wherein said common plane is generally vertical.

21. A watercraft as in claim 18, wherein said cylinder axis is inclined relative to a vertical plane that also contains the rotational axis.

22. A watercraft as in claim 18, wherein at least a portion of the exhaust system extends above at least part of the oxygen sensor.

23. A watercraft as in claim 18, wherein the engine additionally comprises an air intake system that extends above a portion of the oxygen sensor.

24. A watercraft as in claim 18, wherein the engine additionally comprises an air intake system and the oxygen sensor is located between a portion of the air intake system and a portion of the exhaust system.

25. A watercraft comprising a hull defining an engine compartment and an access opening into the engine compartment, an internal combustion engine being positioned within the engine compartment and at least partially below the access opening, the engine including an air intake system communicating with at least one cylinder, an exhaust system that communicates with the at least one cylinder to expel exhaust gases therefrom, and an oxygen sensor arranged to monitor oxygen concentration in the exhaust gases, the oxygen sensor being arranged so as not to be covered by the air intake system and the exhaust system and positioned to lie generally below the access opening, said exhaust system including an expansion chamber, said oxygen sensor lying on one side of an axis of the cylinder and said expansion chamber lying on an opposite side of the axis.

26. A watercraft as defined in claim 25, wherein the oxygen sensor is connected to the engine.

27. A watercraft as defined in claim 25, wherein the oxygen sensor is connected to the exhaust system.

28. The watercraft as in claim 25, wherein the oxygen sensor lies generally between the exhaust system and the air intake system.

29. The watercraft as in claim 25, wherein the engine comprises a cylinder head to which the oxygen sensor is attached.

30. An engine for a small watercraft comprising at least one combustion chamber, an exhaust system that communicates with the at least one combustion chamber to expel exhaust gases therefrom, a collection chamber that receives the exhaust gases through a passage thereof and a sensor connected to the collection chamber and positioned at least partially within a cavity of the collection chamber, and means for draining a liquid from the cavity to the combustion chamber.

31. An engine for a small watercraft comprising at least one combustion chamber, an exhaust system that communicates with the at least one combustion chamber to expel exhaust gases therefrom, a collection chamber that receives the exhaust gases through a passage thereof and a sensor connected to the collection chamber and positioned at least partially within a cavity of the collection chamber, said passage being slanted and extending from said cavity to said at least one combustion chamber so as to drain liquid from said cavity to said combustion chamber.

32. An engine as defined in claim 31, wherein the collection chamber further comprises an outlet connecting said cavity with said passage, said outlet being provided at a lowered end of said cavity.

33. An engine as defined in claim 32, wherein at least a portion of a lower wall of said cavity is slanted towards said outlet.

* * * * *

UNITED STATES PATENT AND TRADEMARK OFFICE

CERTIFICATE OF CORRECTION

PATENT NO. : 6,068,530
DATED : May 30, 2000
INVENTOR(S) : Shigeyuki Ozawa

It is certified that error appears in the above-identified patent and that said Letters Patent is hereby corrected as shown below:

Title page,
Under Item [30] Foreign Application Priority Data, please change June 25, 1907 to -- June 25, 1997 --.

Signed and Sealed this

Nineteenth Day of March, 2002

*Attest:*

*Attesting Officer*

JAMES E. ROGAN
*Director of the United States Patent and Trademark Office*